US010253774B2

(12) United States Patent
Kanayama et al.

(10) Patent No.: US 10,253,774 B2
(45) Date of Patent: Apr. 9, 2019

(54) COMPRESSOR

(75) Inventors: Takehiro Kanayama, Kusatsu (JP); Naoto Tomioka, Kusatsu (JP); Yuuichirou Watanabe, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 1072 days.

(21) Appl. No.: 14/346,704

(22) PCT Filed: Aug. 29, 2012

(86) PCT No.: PCT/JP2012/071833
§ 371 (c)(1),
(2), (4) Date: Mar. 21, 2014

(87) PCT Pub. No.: WO2013/047064
PCT Pub. Date: Apr. 4, 2013

(65) Prior Publication Data

US 2014/0219833 A1 Aug. 7, 2014

(30) Foreign Application Priority Data

Sep. 26, 2011 (JP) ..... 2011-208783

(51) Int. Cl.
*F04C 23/00* (2006.01)
*F04B 39/02* (2006.01)
(Continued)

(52) U.S. Cl.
CPC ..... *F04C 23/008* (2013.01); *F04B 39/0246* (2013.01); *F04B 39/0253* (2013.01);
(Continued)

(58) Field of Classification Search
CPC ..... F04C 240/50–240/56; F04C 23/008; F04C 29/0021; F04C 39/0253; F04C 18/356;
(Continued)

(56) References Cited

U.S. PATENT DOCUMENTS

2011/0067434 A1* 3/2011 Miura ..... F01C 21/02 62/498
2011/0067509 A1* 3/2011 Kleibl ..... F16C 23/04 74/61

FOREIGN PATENT DOCUMENTS

JP 55-69180 U 5/1980
JP 4-166683 A 6/1992
(Continued)

OTHER PUBLICATIONS

International Preliminary Report of corresponding PCT Application No. PCT/JP2012/071833.
(Continued)

*Primary Examiner* — Kenneth J Hansen
(74) *Attorney, Agent, or Firm* — Global IP Counselors, LLP

(57) ABSTRACT

A compressor includes a closed container housing a compression element driven by the shaft of a motor. The compression element includes a first and second bearings supporting first and second shaft portions, and at least one cylinder having at least one cylinder chamber disposed between the first and second bearings. At least one roller is fitted to the shaft in the at least one cylinder chamber. The first bearing is disposed closer to the motor than the second bearing. The first and second bearings have first and second annular grooves opened to the at least one cylinder chamber and first and second elastic portions provided in first and second opposing surfaces, respectively. A diameter of the second shaft portion is smaller than a diameter of the first shaft portion. A rigidity of the second elastic portion is smaller than a rigidity of the first elastic portion.

16 Claims, 3 Drawing Sheets

(51) Int. Cl.
*F04C 29/00* (2006.01)
*F04C 18/356* (2006.01)

(52) U.S. Cl.
CPC ..... *F04C 29/0021* (2013.01); *F04C 18/356* (2013.01); *F04C 2240/601* (2013.01)

(58) Field of Classification Search
CPC ..... F04C 2240/601; F04B 35/04; F04B 39/0246; F16C 17/107; F16C 27/02; F16C 2360/43
See application file for complete search history.

(56) References Cited

FOREIGN PATENT DOCUMENTS

| | | | |
|---|---|---|---|
| JP | 2003-206873 | A | 7/2003 |
| JP | 2010-144680 | A | 7/2010 |
| JP | 2011-111976 | A | 6/2011 |

OTHER PUBLICATIONS

International Search Report of corresponding PCT Application No. PCT/JP2012/071833.

* cited by examiner

COMPRESSOR

CROSS-REFERENCE TO RELATED APPLICATIONS

This U.S. National stage application claims priority under 35 U.S.C. § 119(a) to Japanese Patent Application No. 2011-208783, filed in Japan on Sep. 26, 2011, the entire contents of which are hereby incorporated herein by reference.

TECHNICAL FIELD

The present invention relates to a compressor to be used in, for example, air conditioners, refrigerators and the like.

BACKGROUND ART

Conventionally, there has been provided a compressor which includes a closed container, a compression element to be placed in the closed container, and a motor placed in the closed container to drive the compression element via a shaft (see JP S55-69180 U).

Conventionally, the compression element includes a front bearing and a rear bearing for supporting a shaft, and a cylinder to be placed between the front bearing and the rear bearing. The front bearing is placed closer to the motor than the rear bearing. The diameter of a front portion of the shaft supported by the front bearing is equal to the diameter of a rear portion of the shaft supported by the rear bearing.

A front annular groove and an annular-shaped front elastic portion positioned radially inward of the front annular groove are provided in a surface of the front bearing facing the cylinder, while a rear annular groove and an annular-shaped rear elastic portion positioned radially inward of the rear annular groove are provided in a surface of the rear bearing facing the cylinder.

The front elastic portion and the rear elastic portion are equal in width and height to each other, and it would the case that the rigidity of the front elastic portion and the rigidity of the rear elastic portion are equal to each other.

During operation of the above-described compressor, there may occur, from time to time, deflection of the shaft due to a gas load within the cylinder or other reasons, so that the shaft is brought into contact with the front bearing and the rear bearing. Even in such a case, the front elastic portion and the rear elastic portion are elastically deformed so that the contact of the shaft with the front bearing and the rear bearing can be made to be not point contact but plane contact. Thus, bearing pressures involved are reduced so that seizures are prevented.

In this connection, on condition that the diameter of the rear portion of the shaft is smaller than the diameter of the front portion of the shaft, deflection of the rear portion becomes larger than deflection of the front portion during the operation of the compressor.

In a case where a shaft having such a small-diameter rear portion is used in the above-described conventional compressor, since the rear elastic portion is equal in rigidity to the front elastic portion, it is impossible to increase the elastic deformation of only the rear elastic portion. As a result, the bearing pressure between the rear portion and the rear elastic portion is increased, causing seizures between the rear portion and the rear bearing.

SUMMARY

Technical Problem

An object of the present invention is, therefore, to provide a compressor capable of reducing the bearing pressure between the rear portion and the rear bearing of the shaft so that seizures between the rear portion and the rear bearing can be prevented.

Solution to Problem

In order to solve the problem, a compressor according to the present invention comprises:

a closed container;

a compression element placed in the closed container; and a motor placed in the closed container to drive the compression element via a shaft, wherein the compression element includes:

a front bearing and a rear bearing for supporting the shaft; and at least one cylinder placed between the front bearing and the rear bearing and having a cylinder chamber, and wherein the front bearing is placed closer to the motor than the rear bearing, an annular-shaped front-side annular groove opened to the cylinder chamber of the cylinder and an annular-shaped front-side elastic portion positioned radially inside the front-side annular groove are provided in an opposing surface of the front bearing opposed to the cylinder, an annular-shaped rear-side annular groove opened to the cylinder chamber of the cylinder and an annular-shaped rear-side elastic portion positioned radially inside the rear-side annular groove are provided in an opposing surface of the rear bearing opposed to the cylinder, a diameter of the rear shaft of the shaft supported by the rear bearing is smaller than a diameter of the front shaft of the shaft supported by the front bearing, and a rigidity of the rear-side elastic portion is smaller than a rigidity of the front-side elastic portion.

According to the compressor of this invention, since the diameter of the rear shaft of the shaft is smaller than the diameter of the front shaft of the shaft, deflection of the rear shaft becomes larger than deflection of the front shaft during the operation of the compressor.

In this case, since the rigidity of the rear-side elastic portion is smaller than the rigidity of the front-side elastic portion, elastic deformation of the rear-side elastic portion can be made larger than elastic deformation of the front-side elastic portion. As a result, the bearing pressure between the rear shaft and the rear-side elastic portion can be reduced, so that seizures between the rear shaft and the rear bearing can be prevented. Meanwhile, since deflection of the front shaft is small even with the rigidity of the front-side elastic portion increased, seizures between the front shaft and the front bearing can be prevented. Moreover, since the rigidity of the front-side elastic portion can be made larger, the front-side elastic portion is enabled to endure radial loads from the front shaft so that the front-side elastic portion can be prevented from fatigue failure.

In a compressor of one embodiment, a depth of the rear-side annular groove is larger than a depth of the front-side annular groove.

According to the compressor of this embodiment, since the depth of the rear-side annular groove is larger than the depth of the front-side annular groove, the rigidity of the rear-side elastic portion can easily be made smaller than the rigidity of the front-side elastic portion.

Also in a compressor of one embodiment, an outer circumferential surface of the front-side elastic portion is formed into a cylindrical-surface shape so that a diameter of the outer circumferential surface becomes constant from cylinder chamber side toward counter cylinder chamber side, and an outer circumferential surface of the rear-side elastic portion is formed into a taper shape so that a diameter of the outer circumferential surface gradually increases from cylinder chamber side toward counter cylinder chamber side.

According to the compressor of this embodiment, since the outer circumferential surface of the front-side elastic portion is formed into a cylindrical-surface shape, it becomes easier to form the front-side elastic portion.

Further, since the outer circumferential surface of the rear-side elastic portion is formed into a taper shape, the rigidity of the rear-side elastic portion gradually decreases toward the end portion of the rear-side elastic portion (toward the cylinder chamber). As a result of this, the strength of the rear-side elastic portion on the root portion side (on the counter cylinder chamber side) can be maintained while the bearing pressure of the rear-side elastic portion on the end portion side is reduced.

Also in a compressor of one embodiment, a width of a cylinder chamber-side end portion of the rear-side elastic portion is equal to or smaller than a width of a cylinder chamber-side end portion of the front-side elastic portion.

According to the compressor of this embodiment, since the width of the cylinder chamber-side end portion of the rear-side elastic portion is equal to or smaller than the width of the cylinder chamber-side end portion of the front-side elastic portion, the rigidity of the rear-side elastic portion can easily be made smaller than the rigidity of the front-side elastic portion.

Also in a compressor of one embodiment, the width of the cylinder chamber-side end portion of the rear-side elastic portion is smaller than the width of the cylinder chamber-side end portion of the front-side elastic portion.

According to the compressor of this embodiment, since the width of the cylinder chamber-side end portion of the rear-side elastic portion is smaller than the width of the cylinder chamber-side end portion of the front-side elastic portion, the rigidity of the rear-side elastic portion can be made smaller than the rigidity of the front-side elastic portion with more simplicity.

Also in a compressor of one embodiment, a cylinder chamber-side width of the rear-side annular groove is larger than a cylinder chamber-side width of the front-side annular groove.

According to the compressor of this embodiment, since the cylinder chamber-side width of the rear-side annular groove is larger than the cylinder chamber-side width of the front-side annular groove, the width of the rear-side annular groove can be made larger so that the machining of the rear-side annular groove becomes easier to achieve. Also, since the width of the rear-side annular groove can be made larger, it becomes possible to mold the rear bearing by low-cost sintering in the state that the rear-side annular groove is provided. Thus, the manufacturing time for the rear bearing can be shortened, so that the manufacturing cost for the rear bearing can be reduced.

Also, a compressor according to the present invention comprises:

a closed container;

a compression element placed in the closed container; and a motor placed in the closed container to drive the compression element via a shaft, wherein the compression element includes:

a front bearing and a rear bearing for supporting the shaft; and at least one cylinder placed between the front bearing and the rear bearing and having a cylinder chamber, and wherein the front bearing is placed closer to the motor than the rear bearing, an annular-shaped front-side annular groove opened to the cylinder chamber of the cylinder and an annular-shaped front-side elastic portion positioned radially inside the front-side annular groove are provided in an opposing surface of the front bearing opposed to the cylinder, an annular-shaped rear-side annular groove opened to the cylinder chamber of the cylinder and an annular-shaped rear-side elastic portion positioned radially inside the rear-side annular groove are provided in an opposing surface of the rear bearing opposed to the cylinder, a diameter of the rear shaft of the shaft supported by the rear bearing is smaller than a diameter of the front shaft of the shaft supported by the front bearing, a rigidity of the rear-side elastic portion is smaller than a rigidity of the front-side elastic portion, an outer circumferential surface of the front-side elastic portion is formed into a cylindrical-surface shape so that a diameter of the outer circumferential surface becomes constant from cylinder chamber side toward counter cylinder chamber side, and an outer circumferential surface of the rear-side elastic portion is formed into a taper shape so that a diameter of the outer circumferential surface gradually increases from cylinder chamber side toward counter cylinder chamber side.

According to the compressor of this invention, since the diameter of the rear shaft of the shaft is smaller than the diameter of the front shaft of the shaft, deflection of the rear shaft becomes larger than deflection of the front shaft during the operation of the compressor.

In this case, since the rigidity of the rear-side elastic portion is smaller than the rigidity of the front-side elastic portion, elastic deformation of the rear-side elastic portion can be made larger than elastic deformation of the front-side elastic portion. As a result, the bearing pressure between the rear shaft and the rear-side elastic portion can be reduced, so that seizures between the rear shaft and the rear bearing can be prevented. Meanwhile, since deflection of the front shaft is small even with the rigidity of the front-side elastic portion increased, seizures between the front shaft and the front bearing can be prevented. Moreover, since the rigidity of the front-side elastic portion can be made larger, the front-side elastic portion is enabled to endure radial loads from the front shaft so that the front-side elastic portion can be prevented from fatigue failure.

Also, since the outer circumferential surface of the front-side elastic portion is formed into a cylindrical-surface shape, it becomes easier to form the front-side elastic portion.

Also, since the outer circumferential surface of the rear-side elastic portion is formed into a taper shape, the rigidity of the rear-side elastic portion gradually decreases toward the end portion of the rear-side elastic portion (toward the cylinder chamber). As a result of this, the strength of the rear-side elastic portion on the root portion side (on the counter cylinder chamber side) can be maintained while the bearing pressure of the rear-side elastic portion on the end portion side is reduced.

Advantageous Effects of Invention

According to the compressor of the invention, the diameter of the rear shaft of the shaft is smaller than the diameter of the front shaft of the shaft, and the rigidity of the rear-side elastic portion is smaller than the rigidity of the front-side elastic portion. Therefore, the bearing pressure between the rear shaft of the shaft and the rear bearing can be reduced, so that seizures between the rear shaft and the rear bearing can be prevented.

DESCRIPTION OF EMBODIMENTS

Hereinbelow, the present invention will be described in detail by way of embodiments thereof illustrated in the accompanying drawings.

First Embodiment

Figure 1:
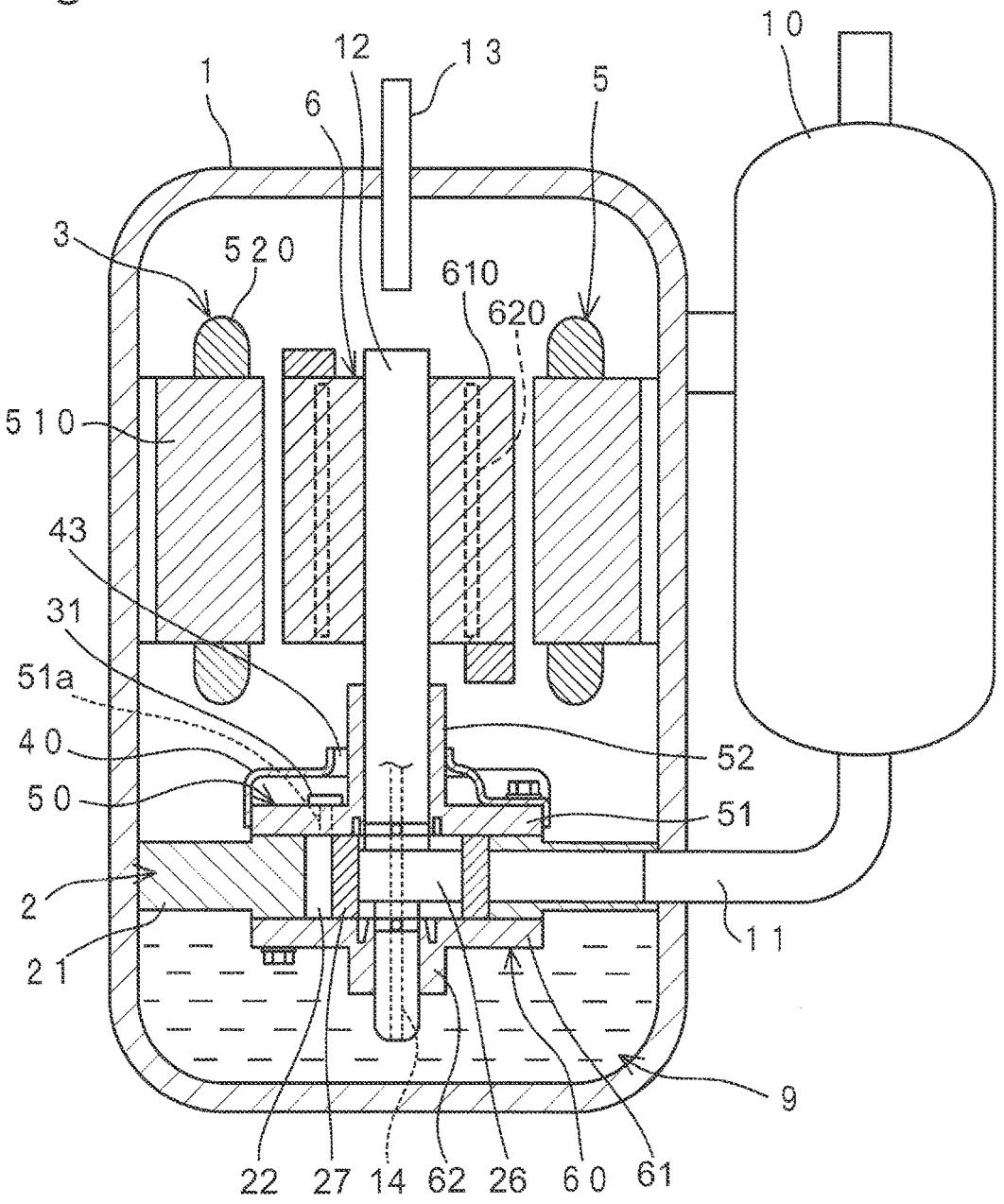
FIG. 1 is a longitudinal sectional view showing a first embodiment of the compressor according to the invention.

FIG. 1 is a longitudinal sectional view showing a first embodiment of the compressor according to the invention. This compressor includes a closed container 1, a compression element 2 placed in the closed container 1, and a motor 3 placed in the closed container 1 to drive the compression element 2 via a shaft 12.

The compressor, which is a so-called vertically positioned high-pressure dome type rotary compressor, is placed in the closed container 1 with the compression element 2 below and the motor 3 above. By a rotor 6 of the motor 3, the compression element 2 is driven via the shaft 12.

The compression element 2 sucks in a refrigerant gas from an accumulator 10 through a suction pipe 11. This refrigerant gas is obtained by controlling a condenser, an expansion mechanism and an evaporator which are not shown and which make up an air conditioner as an example of a refrigeration system in combination with this compressor. Carbon dioxide is used as the refrigerant, but such refrigerants as HC, R410A or other HFCs and R22 or other HCFCs may also be used.

In this compressor, a high-temperature, high-pressure refrigerant gas compressed by the compression element 2 is discharged out from the compression element 2 to fill the inside of the closed container 1. Moreover, the refrigerant gas is passed through a gap between a stator 5 and the rotor 6 of the motor 3 so that the motor 3 is thereby cooled. Thereafter, the refrigerant gas is discharged outside through a discharge pipe 13 provided upward of the motor 3.

An oil reservoir 9 in which lubricating oil is stored is formed in lower portion of a high-pressure region within the closed container 1. This lubricating oil is passed from the oil reservoir 9 through an oil passage 14, which is provided in the shaft 12, so as to be moved to sliding portions such as bearings of the compression element 2 and the motor 3 or the like to lubricate these sliding portions. This lubricating oil is, for example, polyalkylene glycol oil (e.g., polyethylene glycol, polypropylene glycol), ether oil, ester oil or mineral oil.

The motor 3 has the rotor 6, and the stator 5 placed so as to surround outer periphery of the rotor 6.

The rotor 6 has a cylindrical-shaped rotor core 610, and a plurality of magnets 620 embedded in the rotor core 610. The rotor core 610 is formed of stacked electromagnetic steel sheets as an example. The shaft 12 fitted at a central hole portion of the rotor core 610. The magnets 620 are planar-shaped permanent magnets. The plurality of magnets 620 are arrayed at equidistant central angles in the peripheral direction of the rotor core 610.

The stator 5 has a cylindrical-shaped stator core 510, and a coil 520 wound around the stator core 510. The stator core 510, which is formed of plural stacked steel sheets, is fitted into the closed container 1 by shrinkage fit or the like. The coil 520 is wound around each tooth portion of the stator core 510, where the coil 520 in this case is of the so-called concentrated winding.

The compression element 2 has a front bearing 50 and a rear bearing 60 for supporting the shaft 12, a cylinder 21 placed between the front bearing 50 and the rear bearing 60, and a roller 27 placed within the cylinder 21.

The cylinder 21 is fitted on the inner surface of the closed container 1. The cylinder 21 has a cylinder chamber 22. The front bearing 50 is placed closer to the motor 3 (upper) than the rear bearing 60. The front bearing 50 is fixed at an upper-side opening end of the cylinder 21, while the rear bearing 60 is fixed at a lower-side opening end of the cylinder 21.

The shaft 12 has an eccentric portion 26 placed in the cylinder chamber 22 of the compression element 2. The roller 27 is rotatably fitted to the eccentric portion 26. The roller 27 is placed revolvable (swingable) in the cylinder chamber 22, and the refrigerant gas in the cylinder chamber 22 is compressed by the revolving motion of the roller 27.

The front bearing 50 has a disc-shaped end plate portion 51, and a boss portion 52 provided in a center of the end plate portion 51 on one side counter to (above) the cylinder 21 side. The boss portion 52 holds the shaft 12.

In the end plate portion 51, a discharge hole 51*a* is provided so as to communicate with the cylinder chamber 22. A discharge valve 31 is attached to the end plate portion 51 so as to be positioned on one side of the end plate portion 51 counter to the cylinder 21 side. The discharge valve 31 is, for example, a reed valve, which opens and closes the discharge hole 51*a*.

A cup-type muffler cover 40 is attached to the end plate portion 51 on its one side counter to the cylinder 21 side so as to cover the discharge valve 31. The boss portion 52 extends through the muffler cover 40.

Inside of the muffler cover 40 communicates with the cylinder chamber 22 via the discharge hole 51*a*. The muffler cover 40 has a hole portion 43 which allows inside and outside of the muffler cover 40 to be communicated with each other.

The rear bearing 60 has a disc-shaped end plate portion 61, and a boss portion 62 provided in a center of the end plate portion 61 on one side counter to (below) the cylinder 21 side. The boss portion 62 holds the shaft 12. An axial length of the boss portion 62 of the rear bearing 60 is shorter than an axial length of the boss portion 52 of the front bearing 50.

Next, compression action by the compression element 2 is explained below.

First, as the eccentric portion 26 of the shaft 12 is eccentrically rotated, the roller 27 fitted to the eccentric portion 26 is revolved with the outer circumferential surface of the roller 27 kept in contact with the inner circumferential surface of the cylinder chamber 22.

Then, the refrigerant gas of low pressure is sucked into the cylinder chamber 22 through the suction pipe 11. After compressed to high pressure in the cylinder chamber 22, the refrigerant gas of high pressure is discharged from the discharge hole 51*a* of the front bearing 50.

Thereafter, the refrigerant gas discharged from the discharge hole 51*a* is discharged to the outside of the muffler cover 40 via the inside of the muffler cover 40.

Figure 2:
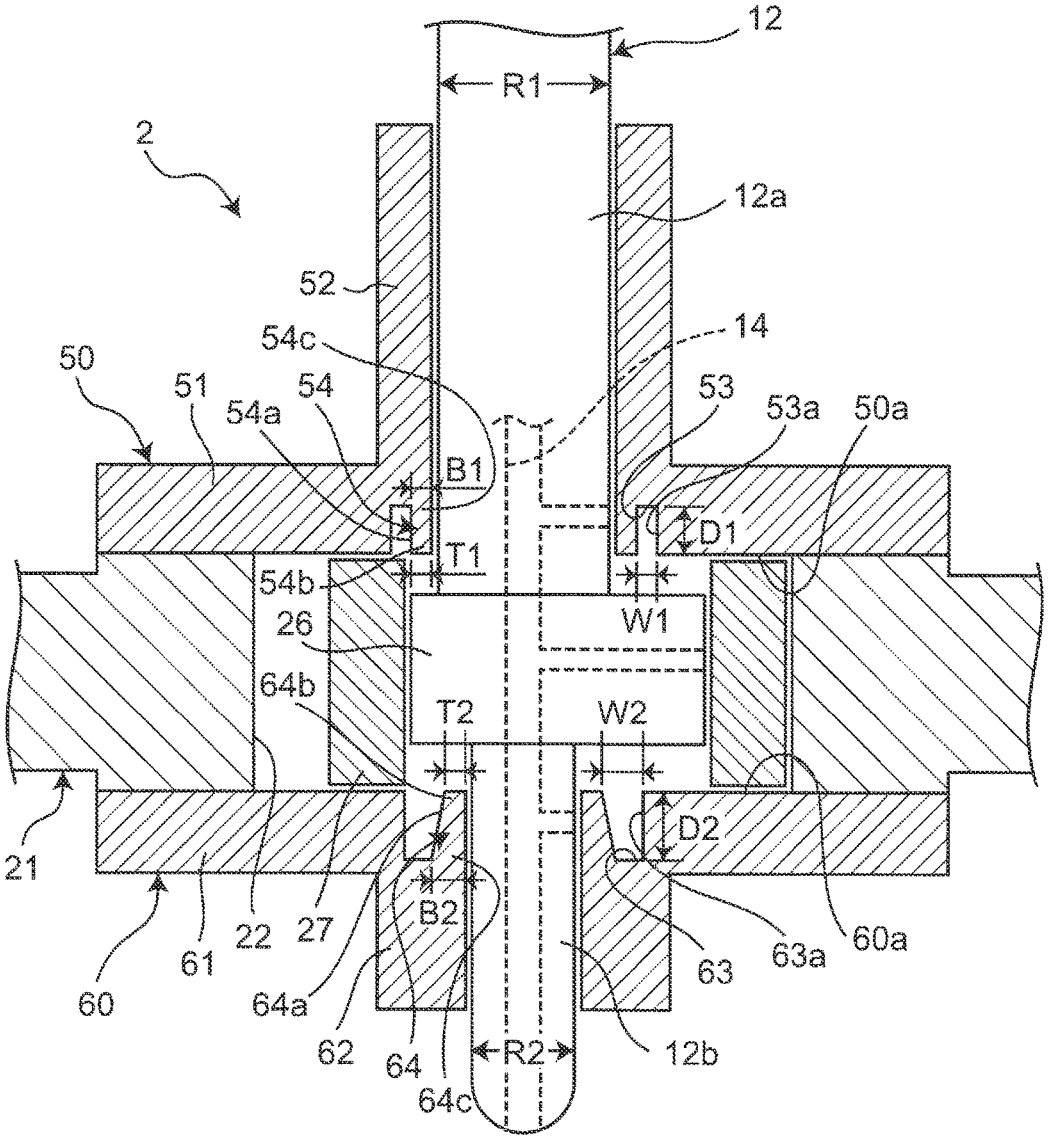
FIG. 2 is an enlarged view of the compression element.

As shown in FIG. 2, the end plate portion 51 of the front bearing 50 has a front-side annular groove 53 in an opposing surface 50*a* opposed to the cylinder 21 (an end face of the roller 27). The front-side annular groove 53, which is formed into a circular annular shape centered on the axial center of the shaft 12, is opened to the cylinder chamber 22. In the end plate portion 51 of the front bearing 50, a circular annular-shaped front-side elastic portion 54 is formed radially inside the front-side annular groove 53.

The end plate portion 61 of the rear bearing 60 has a rear-side annular groove 63 in an opposing surface 60*a* opposed to the cylinder 21 (an end face of the roller 27). The rear-side annular groove 63, which is formed into a circular annular shape centered on the axial center of the shaft 12, is opened to the cylinder chamber 22. In the end plate portion 61 of the rear bearing 60, a circular annular-shaped rear-side elastic portion 64 is formed radially inside the rear-side annular groove 63.

During operation of the above-described compressor, there occurs deflection of the shaft 12 due to a gas load within the cylinder chamber 22 or other reasons, so that the shaft 12 is brought into contact with the front bearing 50 and the rear bearing 60. Upon this occurrence, the front-side elastic portion 54 is elastically deformed so that the contact of the shaft 12 with the front bearing 50 can be made to be not point contact but plane contact. Thus, a bearing pressure of the shaft 12 against the front bearing 50 is reduced so that seizures of the shaft 12 and the front bearing 50 are prevented. Similarly, the rear-side elastic portion 64 is elastically deformed so that seizures of the shaft 12 and the rear bearing 60 are prevented.

The rigidity of the rear-side elastic portion 64 is smaller than the rigidity of the front-side elastic portion 54. More specifically, an outer circumferential surface 54*a* of the front-side elastic portion 54 is formed into such a cylindrical-surface shape that the diameter of the outer circumferential surface 54*a* becomes constant from the cylinder chamber 22 side toward the counter cylinder chamber 22 side. That is, since the diameter of the inner circumferential surface of the front-side elastic portion 54 is constant along the axial direction, the thickness of the front-side elastic portion 54 becomes constant along the axial direction. That is, a width T1 of a cylinder chamber 22-side end portion 54*b* of the front-side elastic portion 54 is equal to a width B1 of a counter cylinder chamber 22-side root portion 54*c* of the front-side elastic portion 54. The root portion 54*c* of the front-side elastic portion 54 is positioned radially inside the bottom face of the front-side annular groove 53.

An outer circumferential surface 64*a* of the rear-side elastic portion 64 is formed into such a taper shape that the diameter of the outer circumferential surface 64*a* gradually increases from the cylinder chamber 22 side toward the counter cylinder chamber 22 side. That is, since the diameter of the inner circumferential surface of the rear-side elastic portion 64 is constant along the axial direction, the thickness of the rear-side elastic portion 64 gradually increases from the cylinder chamber 22 side toward the counter cylinder chamber 22 side. That is, a width T2 of a cylinder chamber 22-side end portion 64*b* of the rear-side elastic portion 64 is smaller than a width B2 of a counter cylinder chamber 22-side root portion 64*c* of the rear-side elastic portion 64. The root portion 64*c* of the rear-side elastic portion 64 is positioned radially inside the bottom face of the rear-side annular groove 63.

The width T2 of the end portion 64*b* of the rear-side elastic portion 64 is equal to the width T1 of the end portion 54*b* of the front-side elastic portion 54.

A depth D2 of the rear-side annular groove 63 is deeper than a depth D1 of the front-side annular groove 53. For example, the depth D1 of the front-side annular groove 53 is 3 mm to 7 mm and the depth D2 of the rear-side annular groove 63 is 4 mm to 10 mm.

The diameter of the outer circumferential surface 53*a* of the front-side annular groove 53 is constant along the axial direction. That is, the width of the front-side annular groove 53 is constant along the depthwise direction of the front-side annular groove 53.

The diameter of the outer circumferential surface 63*a* of the rear-side annular groove 63 is constant along the axial direction. That is, the width of the rear-side annular groove 63 gradually decreases from the cylinder chamber 22 side toward the counter cylinder chamber 22 side.

A cylinder chamber 22-side width W2 of the rear-side annular groove 63 is larger than a cylinder chamber 22-side width W1 of the front-side annular groove 53. For example, the width W1 of the front-side annular groove 53 is 1 mm and the width W2 of the rear-side annular groove 63 is 2.5 mm.

The shaft 12 has a front shaft 12*a* supported by the front bearing 50, and a rear shaft 12*b* supported by the rear bearing 60. A diameter R2 of the rear shaft 12*b* is smaller than a diameter R1 of the front shaft 12*a*. In other words, the inner diameter of the boss portion 62 of the rear bearing 60 is smaller than the inner diameter of the boss portion 52 of the front bearing 50.

An oil passage 14 provided in the shaft 12 is opened to the inner surface of the front-side elastic portion 54 of the front bearing 50, the inner surface of the roller 27 and the inner surface of the rear-side elastic portion 64 of the rear bearing 60, so that lubricating oil drawn up from the oil reservoir 9 is supplied to those inner surfaces. The oil passage 14 is formed by, for example, a spiral groove, and the spiral groove is turned by rotation of the shaft 12 to draw the lubricating oil up.

According to the compressor having the above-described construction, since the diameter R2 of the rear shaft 12*b* of the shaft 12 is smaller than the diameter R1 of the front shaft 12*a* of the shaft 12, deflection of the rear shaft 12*b* during the operation of the compressor is larger than deflection of the front shaft 12*a*.

In this case, since the rigidity of the rear-side elastic portion 64 is smaller than the rigidity of the front-side elastic portion 54, elastic deformation of the rear-side elastic portion 64 can be made larger than elastic deformation of the front-side elastic portion 54. As a result, the bearing pressure between the rear shaft 12*b* and the rear-side elastic portion 64 can be reduced, so that seizures between the rear shaft 12*b* and the rear bearing 60 can be prevented. Meanwhile, since deflection of the front shaft 12*a* is small even with the rigidity of the front-side elastic portion 54 increased, seizures between the front shaft 12*a* and the front bearing 50 can be prevented. Moreover, since the rigidity of the front-side elastic portion 54 can be made larger, the front-side elastic portion 54 is enabled to endure radial loads from the front shaft 12*a* so that the front-side elastic portion 54 can be prevented from fatigue failure.

Also, since the depth D2 of the rear-side annular groove 63 is larger than the depth D1 of the front-side annular groove 53, the rigidity of the rear-side elastic portion 64 can easily be made smaller than the rigidity of the front-side elastic portion 54.

Also, since the outer circumferential surface 54*a* of the front-side elastic portion 54 is formed into a cylindrical-surface shape, it becomes easier to form the front-side elastic portion 54.

Further, since the outer circumferential surface 64*a* of the rear-side elastic portion 64 is formed into a taper shape, the rigidity of the rear-side elastic portion 64 gradually decreases toward the end portion 64*b* of the rear-side elastic portion 64 (toward the cylinder chamber 22). As a result of this, the strength of the rear-side elastic portion 64 on the root portion 64*c* side (on the counter cylinder chamber 22 side) can be maintained while the bearing pressure of the rear-side elastic portion 64 on the end portion 64*b* side is reduced.

Further, since the width T2 of the end portion 64*b* of the rear-side elastic portion 64 is equal to the width T1 of the end portion 54*b* of the front-side elastic portion 54, it becomes easier to form the front-side elastic portion 54 and the rear-side elastic portion 64.

Further, since the width W2 of the rear-side annular groove 63 on the cylinder chamber 22 side is larger than the width W1 of the front-side annular groove 53 on the cylinder chamber 22 side, the width W2 of the rear-side annular groove 63 can be made larger so that the machining of the rear-side annular groove 63 becomes easier to achieve. Also, since the width W2 of the rear-side annular groove 63 can be made larger, it becomes possible to mold the rear bearing 60 by low-cost sintering in the state that the rear-side annular groove 63 is provided. Thus, the manufacturing time for the rear bearing 60 can be shortened, so that the manufacturing cost for the rear bearing 60 can be reduced.

Second Embodiment

Figure 3:
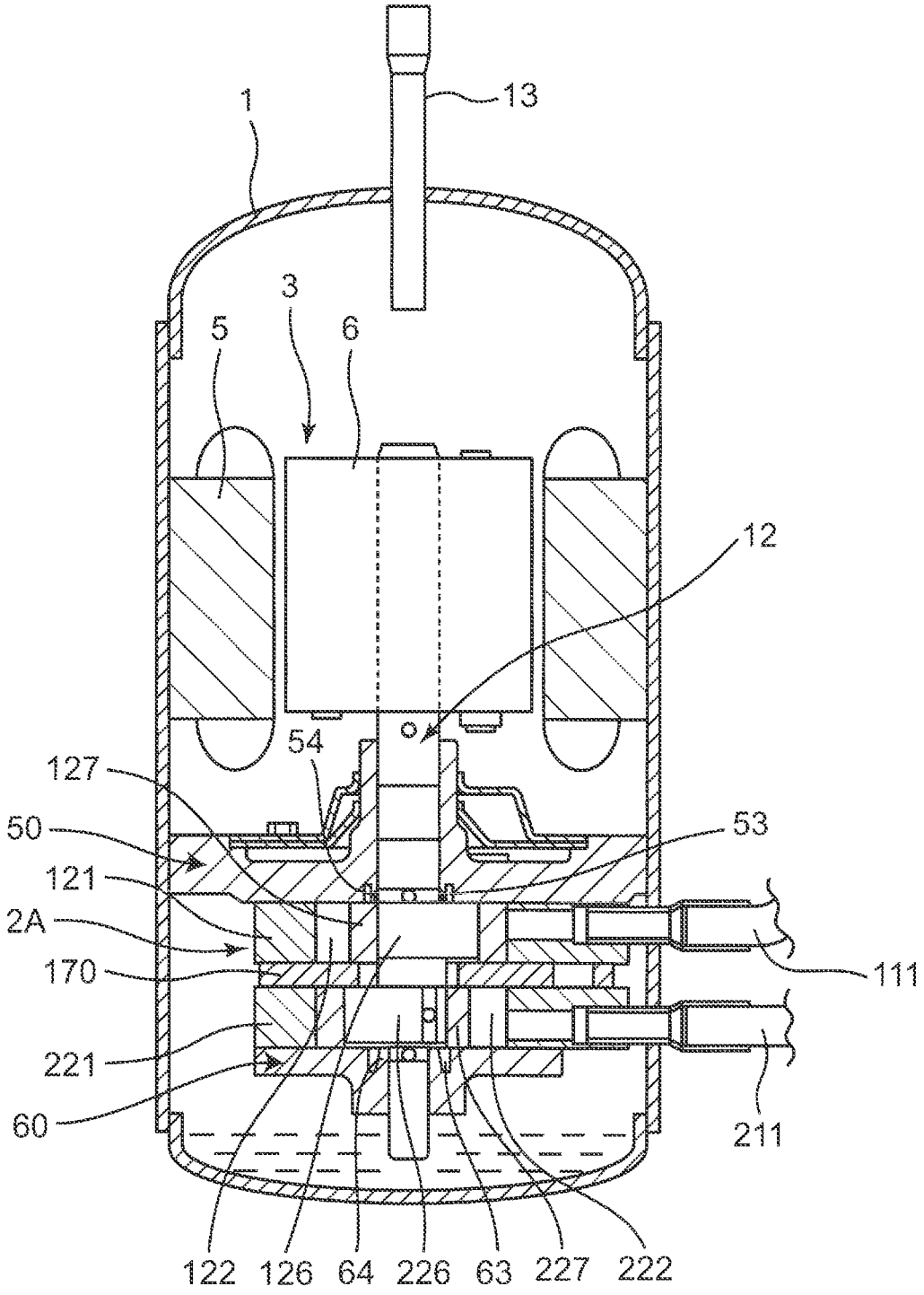
FIG. 3 is a longitudinal sectional view showing a second embodiment of the compressor according to the invention.

FIG. 3 shows a second embodiment of the compressor according to the invention. This second embodiment differs from the first embodiment in terms of the cylinder quantity. In this second embodiment, like reference signs designate like constituent members in conjunction with the first embodiment and so their description is omitted.

As shown in FIG. 3, this compressor is a two-cylinder compressor, in which a compression element 2A includes the front bearing 50, the rear bearing 60, a first cylinder 121, an intermediate member 170 and a second cylinder 221 placed between the front bearing 50 and the rear bearing 60, a first roller 127, and a second roller 227.

The first cylinder 121, the intermediate member 170 and the second cylinder 221 are placed in order along a shaft 12 from the front bearing 50 side toward the rear bearing 60 side.

The first cylinder 121 is sandwiched between the front bearing 50 and the intermediate member 170. A first cylinder chamber 122 of the first cylinder 121 is communicated with a first pipe 111 connected to an unshown accumulator.

The first roller 127 is fitted to a first eccentric portion 126 of the shaft 12 placed in the first cylinder chamber 122. The first roller 127, which is placed revolvable in the first cylinder chamber 122, is eccentrically rotated within the first cylinder 121 to perform compression action. The refrigerant gas compressed in the first cylinder chamber 122 is discharged via a muffler to outside of the first cylinder chamber 122.

The second cylinder 221 is sandwiched between the intermediate member 170 and the rear bearing 60. A second cylinder chamber 222 of the second cylinder 221 is communicated with a second pipe 211 connected to an unshown accumulator.

The second roller 227 is fitted to a second eccentric portion 226 of the shaft 12 placed in the second cylinder chamber 222. The second roller 227, which is placed revolvable in the second cylinder chamber 222, is eccentrically rotated within the second cylinder 221 to perform compression action. The refrigerant gas compressed in the second cylinder chamber 222 is discharged via a muffler to outside of the second cylinder chamber 222.

As in the first embodiment (FIG. 2), the front bearing 50 has, in its opposing surface 50*a* opposed to the first cylinder 121 (an end face of the first roller 127), a front-side annular groove 53 opened to the first cylinder chamber 122. In the opposing surface 50*a* of the front bearing 50, a front-side elastic portion 54 is formed radially inside the front-side annular groove 53.

The rear bearing 60 has, in its opposing surface 60*a* opposed to the first cylinder 121 (an end face of the second roller 227), a rear-side annular groove 63 opened to the second cylinder chamber 222. In the opposing surface 60*a* of the rear bearing 60, a rear-side elastic portion 64 is formed radially inside the rear-side annular groove 63.

The rigidity of the rear-side elastic portion 64 is smaller than the rigidity of the front-side elastic portion 54. Therefore, in this two-cylinder compressor, whereas deflection of the shaft 12 is increased due to an elongated distance between the front bearing 50 and the rear bearing 60, the rigidity of the rear-side annular groove 63 can be decreased so that the elastic deformation of the rear bearing 60 can be increased. As a result of this, the bearing pressure between the shaft 12 and the rear bearing 60 can be decreased with more reliability so that seizures between the shaft 12 and the rear bearing 60 can be prevented with more reliability.

It is noted that the present invention is not limited to the above-described embodiments. It is also possible, for example, to combine respective features of the individual first and second embodiments in various ways.

Further, the width of the end portion of the rear-side elastic portion may be set smaller than the width of the end portion of the front-side elastic portion, in which case the rigidity of the rear-side elastic portion can be made smaller than the rigidity of the front-side elastic portion with more simplicity. Also, the end portion of the rear-side elastic portion may be set smaller in width than the end portion of the front-side elastic portion regardless of the relationship between the depth of the rear-side annular groove and the depth of the front-side annular groove.

Further, regardless of the relationship between the depth of the rear-side annular groove and the depth of the front-side annular groove, it is also possible that the diameter of the rear shaft of the shaft is set smaller than the diameter of the front shaft of the shaft, the rigidity of the rear-side elastic portion is set smaller than the rigidity of the front-side elastic portion, and that the outer circumferential surface of the front-side elastic portion is formed into a cylindrical-surface shape while the outer circumferential surface of the rear-side elastic portion is formed into a taper shape.

Consequently, the elastic deformation of the rear-side elastic portion can be made larger than the elastic deformation of the front-side elastic portion, in which case the bearing pressure between the rear shaft and the rear-side elastic portion can be reduced so that seizures between the rear shaft and the rear bearing can be prevented. Meanwhile, even if the rigidity of the front-side elastic portion is made larger, the deflection of the front shaft is so small that seizures between the front shaft and the front bearing can be prevented. Furthermore, since the rigidity of the front-side elastic portion can be made larger, the front-side elastic portion can withstand radial loads from the front shaft, so that the front-side elastic portion can be prevented from fatigue failure. Also, since the outer circumferential surface of the front-side elastic portion is formed into a cylindrical-surface shape, formation of the front-side elastic portion becomes easier to achieve. Since the outer circumferential surface of the rear-side elastic portion is formed into a taper shape, the rigidity of the rear-side elastic portion gradually decreases toward the end side of the rear-side elastic portion (toward the cylinder chamber). As a result of this, the strength of the rear-side elastic portion on the root portion side (on the counter cylinder chamber side) can be maintained while the bearing pressure of the rear-side elastic portion on the end portion side is reduced.

What is claimed is:

1. A compressor comprising:

a closed container;

a compression element disposed in the closed container; and a motor disposed in the closed container, the motor being configured and arranged to drive the compression element via a shaft, the compression element including a first bearing configured and arranged to support a first shaft portion of the shaft, a second bearing configured and arranged to support a second shaft portion of the shaft, and at least one cylinder disposed between the first bearing and second bearing, the at least one cylinder having at least one cylinder chamber the first bearing being disposed closer to the motor than the second bearing, the first bearing having a first annular groove opened to the at least one cylinder chamber and a first annular shaped elastic portion positioned radially inside of the first annular groove provided in a first opposing surface thereof that is opposed to the at least one cylinder, the second bearing having a disc-shaped end plate portion, a boss portion provided in a center of the end plate portion, and a second annular groove opened to the at least one cylinder chamber and a second annular shaped elastic portion positioned radially inside of the second annular groove provided in a second opposing surface thereof that is opposed to the at least one cylinder, with a depth of the second annular groove being smaller than a thickness of the disc-shaped plate portion, a diameter of the second shaft portion being smaller than a diameter of the first shaft portion, and a rigidity of the second elastic portion being smaller than a rigidity of the first elastic portion.

2. The compressor as claimed in claim 1, wherein the depth of the second annular groove is larger than a depth of the first annular groove.

3. The compressor as claimed in claim 1, wherein a first outer circumferential surface of the first elastic portion is formed into a cylindrical-surface shape so that a first diameter of the first outer circumferential surface becomes constant from a first cylinder chamber side toward a first counter cylinder chamber, and a second outer circumferential surface of the second elastic portion is formed into a taper shape so that a second diameter of the second outer circumferential surface gradually increases from a second cylinder chamber side toward a second counter cylinder chamber side.

4. The compressor as claimed in claim 3, wherein a width of a second cylinder chamber side end portion of the second elastic portion is equal to or smaller than a width of a first cylinder chamber side end portion of the first elastic portion.

5. The compressor as claimed in claim 3, wherein a width of a second cylinder chamber side end portion of the second elastic portion is smaller than a width of a first cylinder chamber side end portion of the first elastic portion.

6. The compressor as claimed in claim 1, wherein a second cylinder chamber side width of the second annular groove is larger than a first cylinder chamber side width of the first annular groove.

7. A compressor comprising:

a closed container;

a compression element in the closed container; and a motor disposed in the closed container, the motor being configured and arranged to drive the compression element via a shaft, the compression element including a first bearing configured and arranged to support a first shaft portion of the shaft, a second bearing configured and arranged to support a second shaft portion of the shaft, and at least one cylinder disposed between the first bearing and second bearing, the at least one cylinder having at least one cylinder chamber, the first bearing being disposed closer to the motor than the second bearing, the first bearing having a first annular groove opened to the at least one cylinder chamber and a first annular shaped elastic portion positioned radially inside of the first annular groove provided in a first opposing surface thereof that is opposed to the at least one cylinder, the second bearing having a disc-shaped end plate portion, a boss portion provided in a center of the end plate portion, and a second annular groove opened to the at least one cylinder chamber and a second annular shaped elastic portion positioned radially inside of the second annular groove provided in a second opposing surface thereof that is opposed to the at least one cylinder, with a depth of the second annular groove being smaller than a thickness of the disc-shaped plate portion, a diameter of the second shaft portion being smaller than a diameter of the first shaft portion, a rigidity of the second elastic portion being smaller than a rigidity of the first elastic portion, a first outer circumferential surface of the first elastic portion being formed into a cylindrical-surface shape so that a first diameter of the first outer circumferential surface becomes constant from a first cylinder chamber side toward a first counter cylinder chamber side, and a second outer circumferential surface of the second elastic portion being formed into a taper shape so that a second diameter of the second outer circumferential surface gradually increases from a second cylinder chamber side toward a second counter cylinder chamber side.

8. The compressor as claimed in claim 2, wherein a first outer circumferential surface of the first elastic portion is formed into a cylindrical-surface shape so that a first diameter of the first outer circumferential surface becomes constant from a first cylinder chamber side toward a first counter cylinder chamber side, and a second outer circumferential surface of the second elastic portion is formed into a taper shape so that a second diameter of the second outer circumferential surface gradually increases from a second cylinder chamber side toward a second counter cylinder chamber side.

9. The compressor as claimed in claim 2, wherein a second cylinder chamber side width of the second annular groove is larger than a first cylinder chamber side width of the first annular groove.

10. The compressor as claimed in claim 3, wherein a second cylinder chamber side width of the second annular groove is larger than a first cylinder chamber side width of the first annular groove.

11. The compressor as claimed in claim 4, wherein a second cylinder chamber side width of the second annular groove is larger than a first cylinder chamber side width of the first annular groove.

12. The compressor as claimed in claim 5, wherein a second cylinder chamber side width of the second annular groove is larger than a first cylinder chamber side width of the first annular groove.

13. The compressor as claimed in claim 7, wherein a free end of the second annular elastic portion is disposed radially inwardly of the first annular elastic portion.

14. The compressor as claimed in claim 7, wherein a second groove outer circumferential surface of the second annular groove is disposed radially inwardly of a first groove outer circumferential surface of the first annular groove.

15. The compressor as claimed in claim 1, wherein a free end of the second annular elastic portion is disposed radially inwardly of the first annular elastic portion.

16. The compressor as claimed in claim 1, wherein a second groove outer circumferential surface of the second annular groove is disposed radially inwardly of a first groove outer circumferential surface of the first annular groove.

* * * * *